US009259824B2

(12) United States Patent
Wu

(10) Patent No.: US 9,259,824 B2
(45) Date of Patent: Feb. 16, 2016

(54) MOUNTING TOOL FOR AN AXLE LOCK NUT

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 188 days.

(21) Appl. No.: 13/975,383

(22) Filed: Aug. 26, 2013

(65) Prior Publication Data

US 2014/0150609 A1 Jun. 5, 2014

(30) Foreign Application Priority Data

Dec. 5, 2012 (TW) ..... 101223612 A

(51) Int. Cl.
*B25B 13/48* (2006.01)
*B25B 27/00* (2006.01)

(52) U.S. Cl.
CPC ..... *B25B 13/48* (2013.01); *B25B 27/0042* (2013.01)

(58) Field of Classification Search
CPC ..... B25B 19/00; B25B 27/00; B25B 27/02; B25B 13/48; B25B 27/007; B25B 27/0035; B25B 27/0042
USPC ..... 72/457, 479, 705
See application file for complete search history.

(56) References Cited

U.S. PATENT DOCUMENTS

| | | | | | |
|---|---|---|---|---|---|
| 1,737,583 | A | * | 12/1929 | Furstenburg | 72/479 |
| 2,547,391 | A | * | 4/1951 | Hauschild | 7/158 |
| 2,637,292 | A | * | 5/1953 | George, Jr. | 29/34 R |
| 3,426,573 | A | * | 2/1969 | Wilson, Jr. | 72/434 |
| 4,034,595 | A | * | 7/1977 | Smith | 72/458 |
| 5,095,735 | A | * | 3/1992 | Schneider, Jr. | 72/479 |
| 5,461,900 | A | * | 10/1995 | Gutierrez | 72/479 |
| 6,058,759 | A | * | 5/2000 | Wilson | 72/479 |

* cited by examiner

*Primary Examiner* — Edward Tolan

(57) ABSTRACT

A mounting tool for an axle lock nut comprises a pole, an end of the pole is a knocking end and the other end is provided with a suppressing unit and a retaining unit, the retaining unit is in adjacent to a side of the suppressing unit and the retaining unit is protruded out of a tail end of the suppressing unit. The mounting tool is used to position the axle lock nut on an automobile axle and to increase the reliability of operation for mounting the axle lock nut on the automobile axle.

5 Claims, 5 Drawing Sheets

MOUNTING TOOL FOR AN AXLE LOCK NUT

BACKGROUND OF THE INVENTION a) Field of the Invention

The present invention relates to an automobile repairing tool, and more particularly to a mounting tool for an axle lock nut. The mounting tool is used to position the axle lock nut on an automobile axle.

b) Description of the Prior Art

An axle lock nut that is screwed at an automobile axle to position a brake structure is disclosed in FIG. 1. The axle lock nut 1 is constituted primarily by a body 11. An end of the body 11 is protruded axially with a collar 12, and the other end is connected with a gasket 13. As shown in FIG. 2 and FIG. 3, the axle lock nut 1 is screwed at an automobile axle 2 to position a brake device 3 that is disposed on the axle 2; whereas, an outer rim of the axle 2 is concaved with a groove 21 along the long axis of the axle 2. When the axle lock nut 1 is mounted on the axle 2, the body 11 is screwed at the axle 2 until being positioned, and then a working end of a flathead screwdriver is abutted at an outer rim of the collar 12, followed by knocking a handle of the screwdriver with a hammer, which forces the collar 12 to be locally deformed plastically that the collar 12 can be latched into the groove 21 (as shown in FIG. 3). Accordingly, the axle lock nut 1 and the axle 2 cannot rotate with respect to each other, and the axle lock nut 1 can be mounted and positioned on the axle 2.

When the flathead screwdriver is abutted at the outer rim of the collar 12, an edge at a straight tail end of the working end of the screwdriver is abutted at the collar 12. Therefore, when the handle of the screwdriver is knocked by the hammer, the working end of the screwdriver can slide easily, which decreases the reliability of operation for suppressing and deforming the collar 12. Furthermore, if the abovementioned sliding phenomenon allows the working end of the screwdriver to slide from a surface of the collar 12, the collar 12 cannot be deformed and the screwdriver that slides from the surface of the collar 12 can even touch mistakenly a neighboring part to damage that part. For example, if the working end of the screwdriver slides from the surface of the collar 12 and then knocks the axle 2, the threads of the axle 2 can be damaged.

SUMMARY OF THE INVENTION

Briefly, the present invention providing a mounting tool comprising a pole, wherein an end of the pole is a knocking end, the other end is provided with a suppressing unit and a retaining unit, the retaining unit is in adjacent to a side of the suppressing unit and the retaining unit is protruded out of a tail end of the suppressing unit.

Thus, the primary object of the present invention is to provide a mounting tool for an axle lock nut, with the functions of positioning the axle lock nut on the automobile axle and increasing the reliability of operation for mounting the axle lock nut on the axle.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
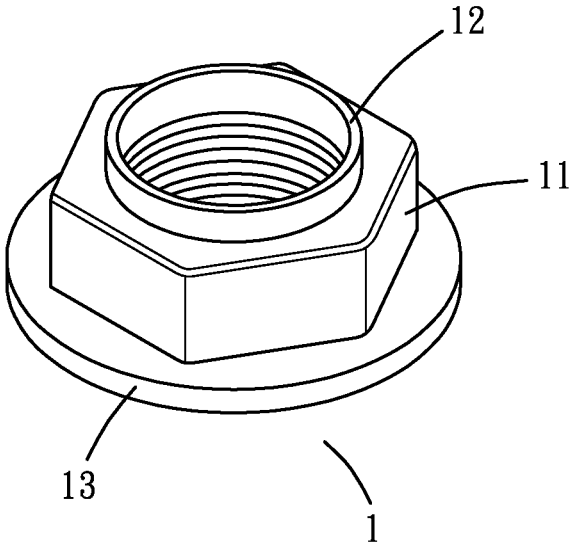
FIG. 1 PRIOR ART
FIG. 1 shows a three-dimensional view of a conventional axle lock nut.
Figure 2:
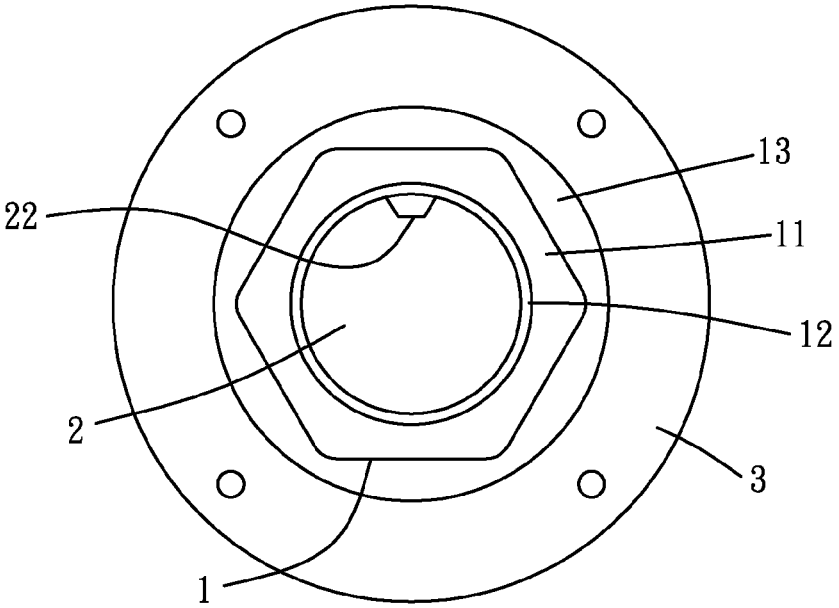
FIG. 2 PRIOR ART
FIG. 2 shows a first schematic view of mounting the conventional axle lock nut on an automobile axle.
Figure 3:
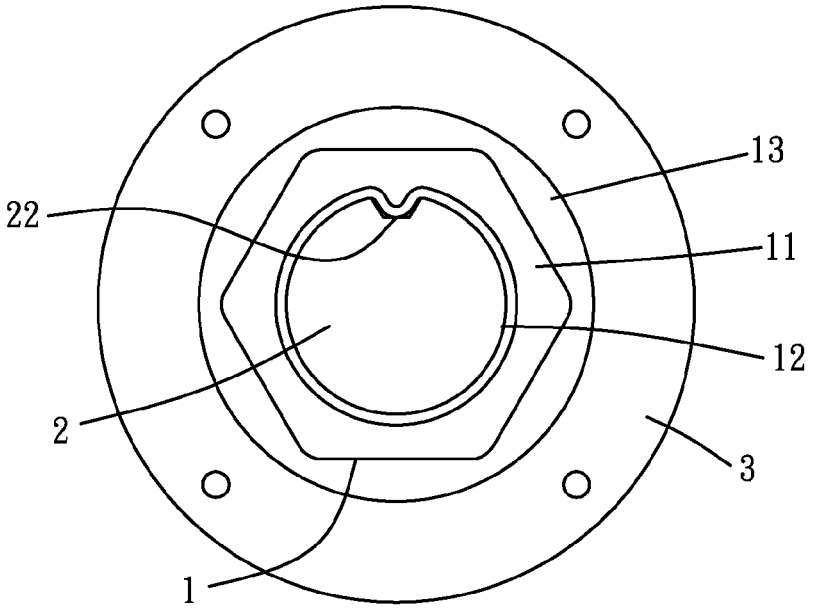
FIG. 3 PRIOR ART
FIG. 3 shows a second schematic view of mounting the conventional axle lock nut on the automobile axle.
Figure 4:
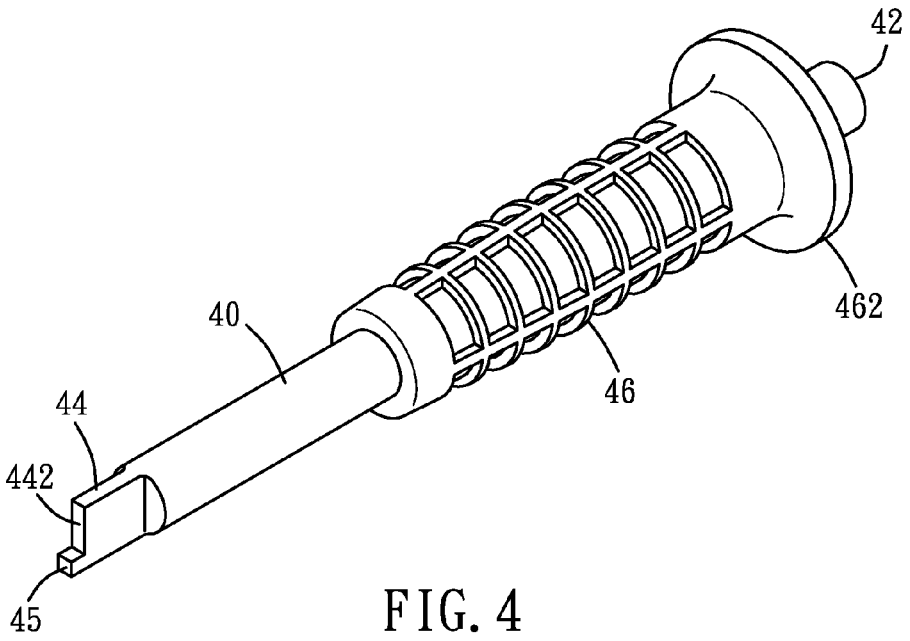
FIG. 4 shows a three-dimensional view of a first embodiment of the present invention.
Figure 5:
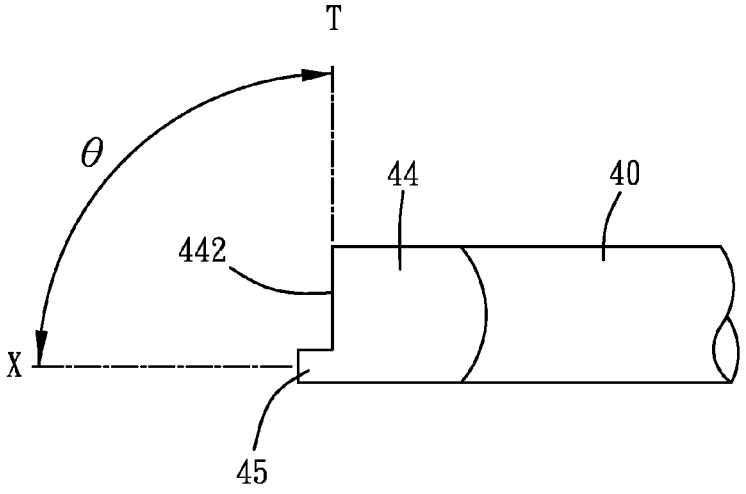
FIG. 5 shows a left view of the first embodiment of the present invention, disclosing local enlargement of a suppressing unit and a retaining unit.
Figure 6:
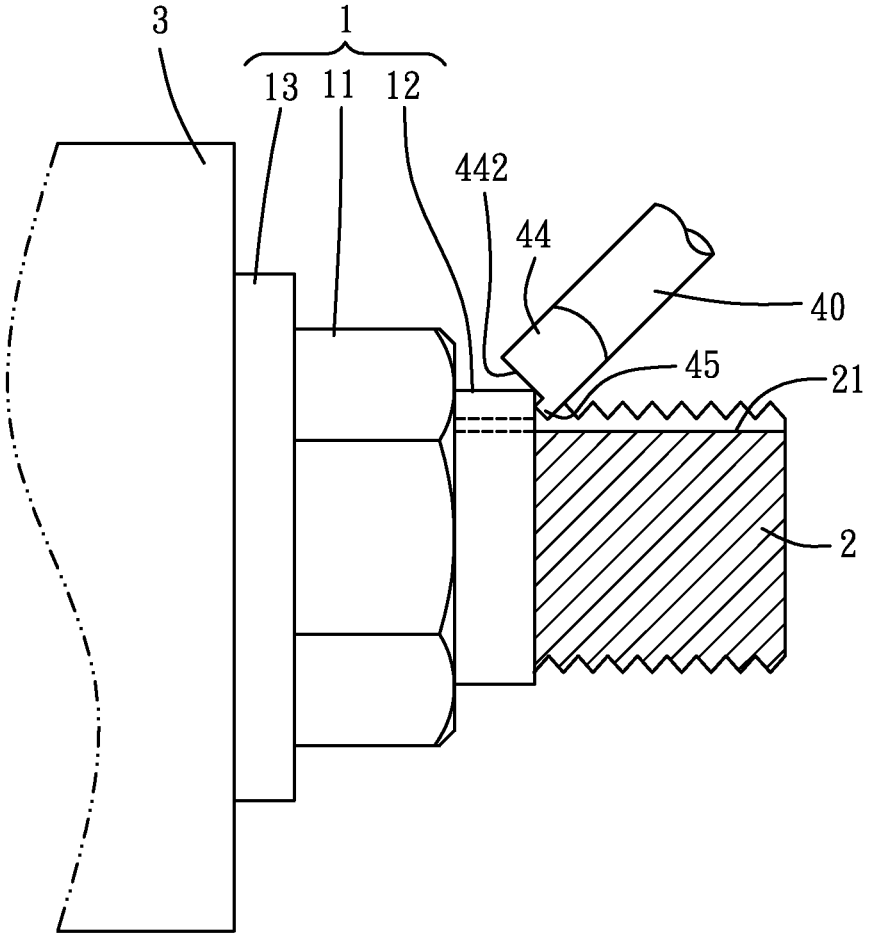
FIG. 6 shows a left view of a usage state of the first embodiment of the present invention.
Figure 7:
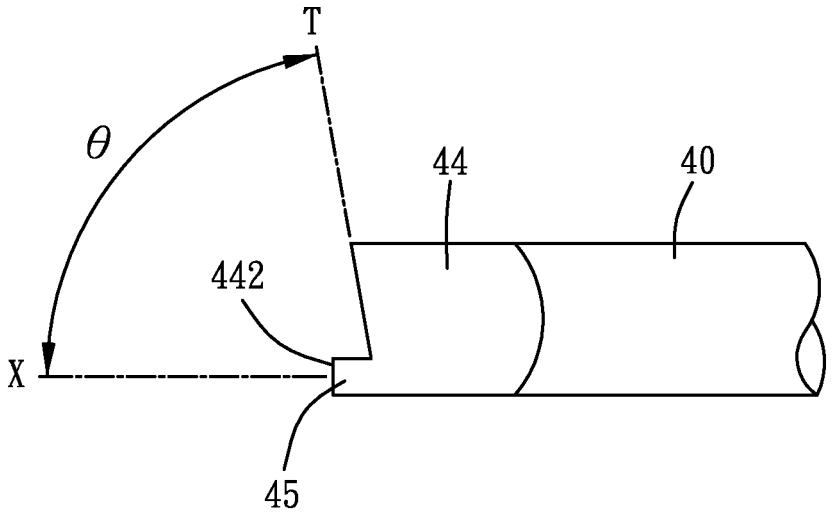
FIG. 7 shows a left view of a second embodiment of the present invention, disclosing local enlargement of the suppressing unit and the retaining unit.

To further disclose clearly the technical means of the present invention and the objects and functions achieved thereby, the preferred embodiments are described in details in association with the drawings, wherein FIG. 4 is a three-dimensional view of a first embodiment, FIG. 5 is a left view of the first embodiment showing local enlargement of a suppressing unit and a retaining unit, FIG. 6 is a left view of a usage state of the first embodiment, and FIG. 7 is a left view of a second embodiment showing local enlargement of the suppressing unit and the retaining unit.

Referring to FIG. 4 and FIG. 5, it shows a first embodiment of the mounting tool for an axle lock nut, according to the present invention. The mounting tool comprises a pole 40, an end of the pole 40 is provided axially with a knocking end 42 and the other end is provided with a suppressing unit 44 and a retaining unit 45. The retaining unit 45 is adjacent to a side of the suppressing unit 44 and the retaining unit 45 is protruded out of a tail end of the suppressing unit 44. In addition, the retaining unit 45 is formed by extending the pole 40 along the long axis thereof, forming a suppressing surface 442 at a tail end of the suppressing unit 44. If a central axis of the retaining unit 45 is X and a tangent of the suppressing surface 442 is T, then an included angle θ between X and T is 90°.

Moreover, the pole 40 can be further sheathed with a handle 46. The handle 46 is disposed between the knocking end 42 and the suppressing unit 44 to provide a user with convenience in holding and operating the pole 40. Besides that, the handle 46 is protruded outward with a protective flange 462 in adjacent to the knocking end 42.

As shown in FIG. 4 and FIG. 6, when the mounting tool for an axle lock nut, according to the present invention, is to mount an axle lock nut 1 on an automobile axle 2, the axle lock nut 1 is screwed at the axle 2 until being positioned, and then a tail end of the pole 40 is abutted between an outer rim of a collar 12 of the axle lock nut 1 and a groove 21 of the axle 2; whereas, the suppressing unit 44 touches a corner between an outer circumference 122 and an end surface 124 of the collar 12 by the suppressing surface 442, allowing the retaining unit 45 to face opposite to the end surface 124. Therefore, the pole 40 can be abutted at the collar 12; whereas, the collar 12 and the retaining unit 45 will stop with respect to each other. Next, the knocking end 42 is hit by a hammer (not shown in the drawings) and the suppressing unit 44 will form a suppressing force to the collar 12, which forces the collar 12 to be locally deformed plastically that the collar 12 can be latched into the groove 21, thereby accomplishing the operation of mounting the axle lock nut 1 on the axle 2. Furthermore, when the user holds the handle 46 and hits the knocking end 42 with the hammer, the user's hand that holds the handle 46 will be protected by the protective flange 462 from being hit by the hammer mistakenly, thereby improving the safety of use.

By the retaining unit 45, the pole 40 can be actually abutted at the collar 12, and when the knocking end 42 of the pole 40 is hit by the hammer, the suppressing unit 44 can keep touching the collar 12 without sliding, which increases the reliability of operation for deforming the collar 12 by the suppressing unit 44, and prevents the pole 40 from damaging other part in adjacent to the axle lock nut 1 by a mistake.

A second embodiment of the present invention is derived from the abovementioned first embodiment, and hence, no further description will be disclosed to the features that are identical to both embodiments. Referring to FIG. 7, in the second embodiment of the present invention, the tail end of the suppressing unit 44 is the suppressing surface 442, and if a central axis of the retaining unit 45 is X and a tangent of the suppressing surface 442 is T, then an included angle θ between X and T is greater than 0° and less than 90°.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A mounting tool for an axle lock nut, which is used to position the axle lock nut on an automobile axle, the axle lock nut is provided with a body, an end of the body is protruded axially with a collar, the collar has an outer rim, and the other end is connected with a gasket, the axle lock nut is screwed at an automobile axle, an outer rim of the axle is concaved with a groove along the long axis of the axle, the mounting tool comprising a pole, wherein an end of the pole is a knocking end, the other end is provided with a suppressing unit and a retaining unit, the retaining unit is in adjacent to a side of the suppressing unit and retaining unit is protruded out of a tail end of the suppressing unit, a tail end of the suppressing unit is a suppressing surface, the tail end is abutted between the outer rim of the collar of the axle lock nut and the groove of the axle, wherein, the suppressing unit touches the corner of the collar, allowing the retaining unit to face opposite the end surface of the collar, the collar and the retaining will stop with respect to each other.

2. The mounting tool for an axle lock nut, according to claim 1, wherein a central axis of the retaining unit is X and a tangent of the suppressing surface is T, then an included angle θ between X and T is greater than 0° and less than or equal to 90°.

3. The mounting tool for an axle lock nut, according to claim 1, wherein the retaining unit is formed by extending the pole along the long axis thereof.

4. The mounting tool for an axle lock nut, according to claim 1, wherein the pole is sheathed with a handle.

5. The mounting tool for an axle lock nut, according to claim 4, wherein the handle is disposed between the knocking end and the suppressing unit.

* * * * *